US007302386B2

(12) United States Patent
Lee et al.

(10) Patent No.: US 7,302,386 B2
(45) Date of Patent: Nov. 27, 2007

(54) FOCUSED SEARCH METHOD OF FIXED CODEBOOK AND APPARATUS THEREOF

(75) Inventors: Eung Don Lee, Daejeon (KR); Do Young Kim, Daejeon (KR); Bong Tae Kim, Daejeon (KR)

(73) Assignee: Electronics and Telecommunications Research Institute (KR)

( * ) Notice: Subject to any disclaimer, the term of this patent is extended or adjusted under 35 U.S.C. 154(b) by 852 days.

(21) Appl. No.: 10/712,336

(22) Filed: Nov. 12, 2003

(65) Prior Publication Data

US 2004/0098254 A1 May 20, 2004

(30) Foreign Application Priority Data

Nov. 14, 2002 (KR) ..... 10-2002-0070646

(51) Int. Cl.
*G10L 19/10* (2006.01)

(52) U.S. Cl. ..... 704/220; 704/219; 704/223; 704/230; 704/229

(58) Field of Classification Search ..... 704/219, 704/223, 222, 216, 220, 230, 229, 221
See application file for complete search history.

(56) References Cited

U.S. PATENT DOCUMENTS 5,822,724 A * 10/1998 Nahumi ..... 704/223
5,867,814 A * 2/1999 Yong ..... 704/216
6,173,257 B1 * 1/2001 Gao ..... 704/220
6,728,669 B1 * 4/2004 Benno ..... 704/219
7,096,181 B2 * 8/2006 Jung et al. ..... 704/222
2003/0225576 A1 * 12/2003 Li et al. ..... 704/222

FOREIGN PATENT DOCUMENTS

KR 10-2000-0018838 4/2000
KR 1020000074365 12/2000

OTHER PUBLICATIONS

Proceedings of ICSP '98, "An 8-kb/s Conjugate-structure Algebraic CELP (CS-ACELP Speech Coding", L. Juan, et al., 4 pages.
International Telecommunication Union, Coding of Speech At 8 kbit/s Using Conjugate-Structure Algebraic-Code-Excited Linear-Prediction (CS-ACELP), 35 pages.

* cited by examiner

*Primary Examiner*—Vijay Chawan
(74) *Attorney, Agent, or Firm*—Blakely, Sokoloff, Taylor & Zafman

(57) ABSTRACT

There are provided a search method of a fixed codebook, and more particularly, a focused search method and apparatus thereof, for being applied to a speech codec for Voice over Internet Protocol (VoIP). The focused search method of the fixed codebook includes: calculating absolute values of correlation vectors of respective pulse locations of tracks 0, 1, 2, and 3 and arranging the pulse locations in a descending order of the absolute values; and selecting a predetermined number of pulse locations for each track among candidate pulse locations arranged and conducting focused search of the selected result. Therefore, it is possible to significantly reduce a calculation amount required for fixed codebook search while maintaining tone quality in a similar level.

13 Claims, 3 Drawing Sheets

FOCUSED SEARCH METHOD OF FIXED CODEBOOK AND APPARATUS THEREOF

BACKGROUND OF THE INVENTION

This application claims the priority of Korean Patent Application No. 2002-70646, filed on Nov. 14, 2002, in the Korean Intellectual Property Office, the disclosure of which is incorporated herein in its entirety by reference.

1. Field of the Invention

The present invention relates to a search method of a fixed codebook, and more particularly, to a focused search method and apparatus thereof, for being applied to an audio codec for Voice over Internet Protocol (VoIP).

2. Description of the Related Art

Various methods for converting speech to a digital signal suitable for transmission have been used. Particularly, in a mobile communication environment, it is required to accommodate more users in a limited channel and provide better speech quality while transmitting speech data at a lower bit rate. A function which converts speech into a digital signal and compresses the digital signal is performed by a vocoder. The vocoder as a device for coding speech includes a waveform codec, a source codec, a hybrid codec, etc. A CELP codec is one type of hybrid codec using a compression algorithm used when encoding speech at a low bit rate. The CELP codec creates a speech signal with good quality at a bit rate lower than 16 kbps.

The CELP codec constitutes a codebook using different white gaussian noises. The CELP codec transmits, instead of a sound signal, an index corresponding to optimal white gaussian noise in which an error between an input sound signal and synthesized sound is minimized, thereby obtaining a compression effect. Also, the channel capacity of a gateway according to the Voice over Internet Protocol (VoIP) is greatly dependent on the complexity of the audio codec. The complexity of an audio codec using the CELP coding algorithm is decided according to methods for fixed codebook search.

Table 1 shows a fixed codebook structure of a G.729 sound codec.

TABLE 1

| Track | Pulse | Code | Pulse location |
|---|---|---|---|
| 0 | $i_0$ | $S_0$: ±1 | $M_0$: 0 5 10 15 20 25 30 35 |
| 1 | $i_1$ | $s_1$: ±1 | $m_0$: 1 6 11 16 21 26 31 36 |
| 2 | $i_2$ | $s_2$: ±1 | $m_0$: 2 7 12 17 22 27 32 37 |
| 3 | $i_3$ | $s_3$: ±1 | $m_0$: 3 8 13 18 23 28 33 38 |
| | | | 4 9 14 19 24 29 34 39 |

As shown in Table 1, pulses $i_0$, $i_1$, $i_2$, and $i_3$ are located in tracks 0, 1, 2, and 3, respectively. Each pulse has a value of +1 or −1. Also, pulse location indexes 0, 5, 10, . . . , 35 are in track 0, pulse location indexes 1, 6, 11, . . . , 36 are in track 1, pulse location indexes 2, 7, 12, . . . , 37 are in track 2, and pulse location indexes 3, 8, 13, . . . , 39 are in track 3. In this case, searching for a fixed codebook refers to searching for an optimal pulse location for each track of the tracks 0, 1, 2, and 3.

A fixed codebook vector of the G.729 standards has only 4 pulse locations among 40 pulse locations (equal to the sample number of subframes), where each value of the pulses is limited into −1 or +1. Each of the four pulse locations can be selected from each track of the four tracks shown in Table 1. The track 3 has 16 pulse locations, differently from other tracks. This is an inherent characteristic of the G.729 standards. In this case, searching for the fixed codebook refers to searching for four most optimal pulse locations and codes among the 40 pulse locations.

Among methods for fixed codebook search, a complete search method used in a 6.3 kbps audio codec according to the G.723.1 standards is a method that searches all possible pulse locations. Therefore, a high-quality sound can be obtained using this method. However, such a complete search method requires a large calculation amount, and accordingly, is time consuming.

To solve this problem, a focused search method is used in a 5.3 kbps audio codec according to the G.729 or G.723.1 standard.

FIG. 1 is a flowchart of a conventional focused search method.

The focused search method predetermines a threshold value in consideration of respective pulse locations of tracks 0, 1, and 2 (step S110), creates pulse location combinations which are selected in each track of tracks 0, 1, and 2 (step S120), compares the threshold value with a summed value of correlation vectors for each pulse location combination (step S130), and searches for the pulse locations of the track 3 for only the summed value of correlation vectors for pulse location combinations above the threshold value (step S140). After the pulse locations of track 3 are searched for, it is determined whether all pulse location combinations of tracks 0, 1, and 2 are completely searched for (step S150). If search is not complete, respective pulse locations of tracks 0, 1, and 2 are increased and process feeds back to step S120 that creates pulse location combinations for each track of tracks 0, 1, and 2 (step S160). If the summed value is equal to or smaller than the threshold value, a fixed codebook search for a corresponding subframe is terminated (step S170).

However, such a focused search method has a problem in that a large calculation amount is required and calculation complexity is not uniform since all pulse location combinations of tracks 0, 1, and 2 are compared to a threshold value.

Meanwhile, a fixed codebook high-speed search method used in an audio codec is disclosed in Korean Patent Laid-open Publication No. 2001-0095585, filed on Apr. 11, 2000 by C&S Technology, Inc., published on Nov. 7, 2001. The above Patent terminates fixed codebook search if a combination in which a summed value thereof is below a threshold value is generated when deciding combinations for search of track 3, by arranging pulse locations in a descending order in advance in each track of tracks 0, 1, and 2 according to their correlation values, thereby removing unnecessary calculation.

However, in the above-described method, a problem still exits in that unnecessary search is conducted for the lower several pulse locations for each track having little probability of being selected as an optimal pulse location in each track whose pulse locations arranged in a descending order, when deciding the combinations for search of track 3.

SUMMARY OF THE INVENTION

The present invention provides a focused search method and apparatus capable of greatly reducing a calculation amount, in order to solve problems occurred when fixed codebook search is conducted using a conventional focused search method.

According to an aspect of the present invention, there is provided a focused search method of a fixed codebook, the method comprising: calculating absolute values of correlation vectors of respective pulse locations of tracks 0, 1, 2, and 3 and arranging the pulse locations in a descending order of the absolute values; and selecting a predetermined number of pulse locations for each track among candidate pulse locations arranged and conducting focused search of the selected result.

According to another aspect of the present invention, there is provided a focused search method of a fixed codebook, the method comprising: calculating absolute values of correlation vectors for respective pulse locations of tracks 0, 1, 2, and 3; arranging the pulse locations according to the absolute values of the correlation vectors in each track of the tracks 0, 1, 2, and 3; selecting candidate pulse locations to be subjected to focused search in each track of the tracks 0, 1, 2, and 3; setting a threshold value in consideration of the selected candidate pulse locations; summing the absolute values of the correlation vectors for each track; determining whether the summed value is greater than the threshold value; searching for pulse locations of track 3 if the summed value is greater than the threshold value and terminating search if the summed value is equal to or smaller than the threshold value; determining whether all pulse location combinations of the tracks 0, 1, and 2 are completely searched for after search of the track 3 is conducted; and increasing the respective pulse locations of the tracks 0, 1, and 2 by one and feeding back to step of summing the absolute values of the correlation vectors if the all pulse location combinations are not completely searched for.

According to still another aspect of the present invention, there is provided a focused search apparatus of a fixed codebook comprising: an absolute value calculator which calculates absolute values of correlation vectors of respective pulse locations of tracks 0, 1, 2, and 3; a pulse location arrangement unit which arranges pulse locations in each track of the tracks 0, 1, 2, and 3 according to the absolute values of the correlation vectors calculated in the absolute value calculator; a pulse location selector which selects candidate pulse locations to be subjected to focused search in each track of the tracks 0, 1, 2, and 3; a threshold value setting unit which sets a threshold value in consideration of the selected candidate pulse locations; an absolute value summer which sums the absolute values of the correlation vectors of the respective pulse locations of the tracks 0, 1, and 2; a determination unit whether determines whether the summed value is greater than the threshold value; a unit for searching for pulse locations of track 3 if the summed value is greater than the threshold value; and a search completion determination unit which determines whether all pulse location combinations of the tracks 0, 1, and 2 are completely searched for after search of the track 3 is conducted.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, an embodiment of the present invention will be described in detail with reference to the appended drawings.

In fixed codebook search, a codebook vector is selected using Equation 1.

$$\mathrm{Max}\frac{C_k^2}{E_k} = \mathrm{Max}\frac{(d^t c_k)^2}{c_k^t \Phi c_k} \tag{1}$$

Here $c_k$ is a k-th fixed codebook vector, superscript t indicates a transpose of a matrix or a vector, d is a correlation vector, and $\Phi$ is a correlation between the correlation vector d and an impulse response of a linear estimation synthesis filter.

The correlation $\Phi$ is calculated using Equations 2 and 3, as follows.

$$d(n) = \sum_{i=n}^{39} x_2(i)(i-n), \quad i = 0, \ldots, 39 \tag{2}$$

$$\Phi(i, j) = \sum_{n=j}^{39} h(n-i)h(n-j), \quad i = 0, \ldots, 39, \quad j = i, \ldots, 39 \tag{3}$$

In Equation 2, $x_2(n)$ is a target signal to be subjected to fixed codebook search, and h(n) is an impulse response of a low-pass (LP) synthesis filter. Also, C and E values in above Equation 1 are calculated by Equations 4 and 5, as follows.

$$C = \sum_{i=0}^{3} s_i d(m_i) \tag{4}$$

$$E = \sum_{i=0}^{3} \Phi(m_i, m_i) + 2\sum_{i=0}^{2}\sum_{j=i+1}^{3} s_i s_j \Phi(m_i, m_j) \tag{5}$$

Here, $s_i$ is an i-th pulse code and $m_i$ is an i-th pulse location. In Equation 5, if $s_i$ is set to the sign values of d(i), Equation 4 can be expressed by Equation 6.

$$C = \sum_{i=0}^{3} |d(m_i)| \tag{6}$$

Figure 1:
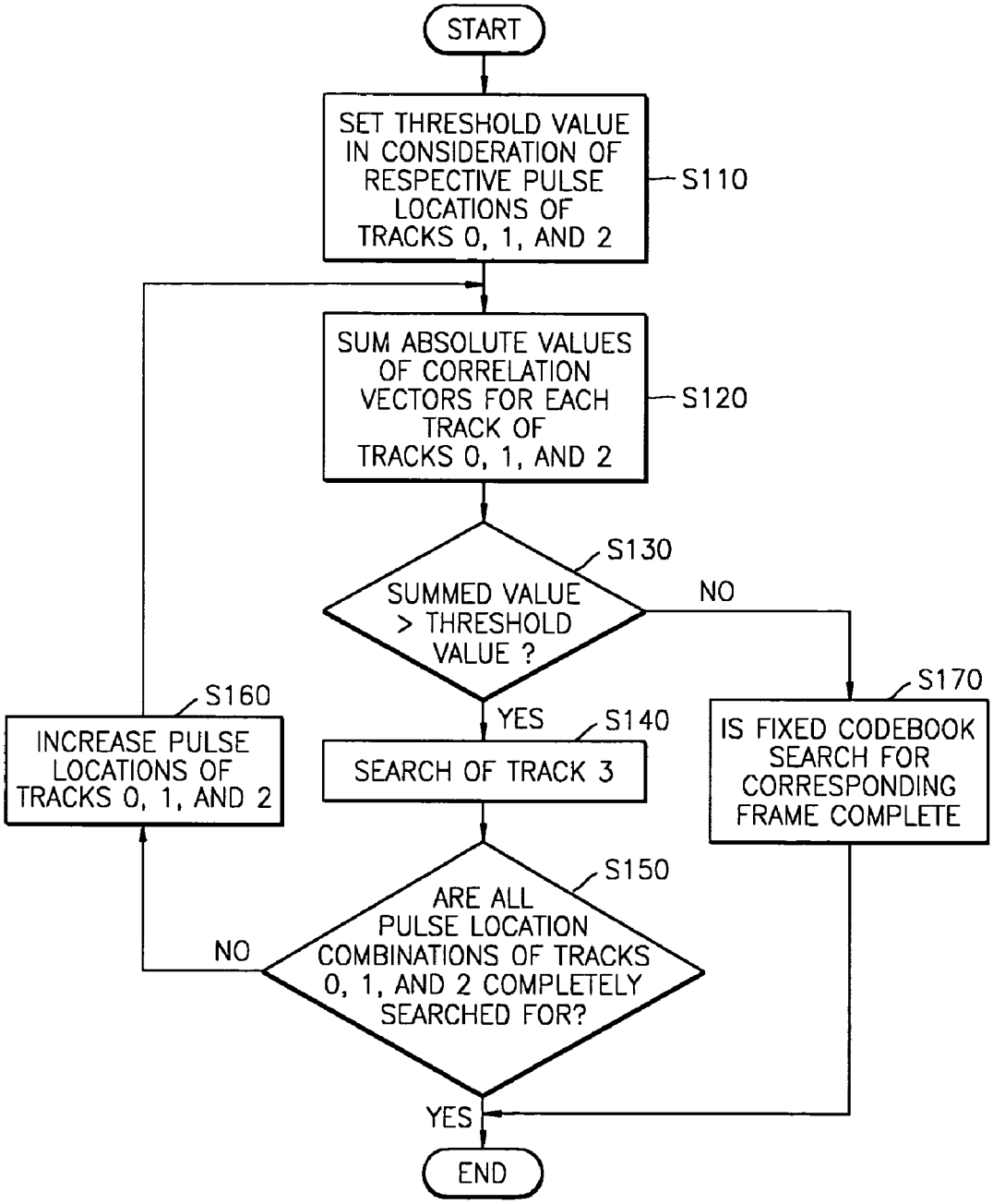
FIG. 1 is a flowchart illustrating a conventional focused search method.
Figure 2:
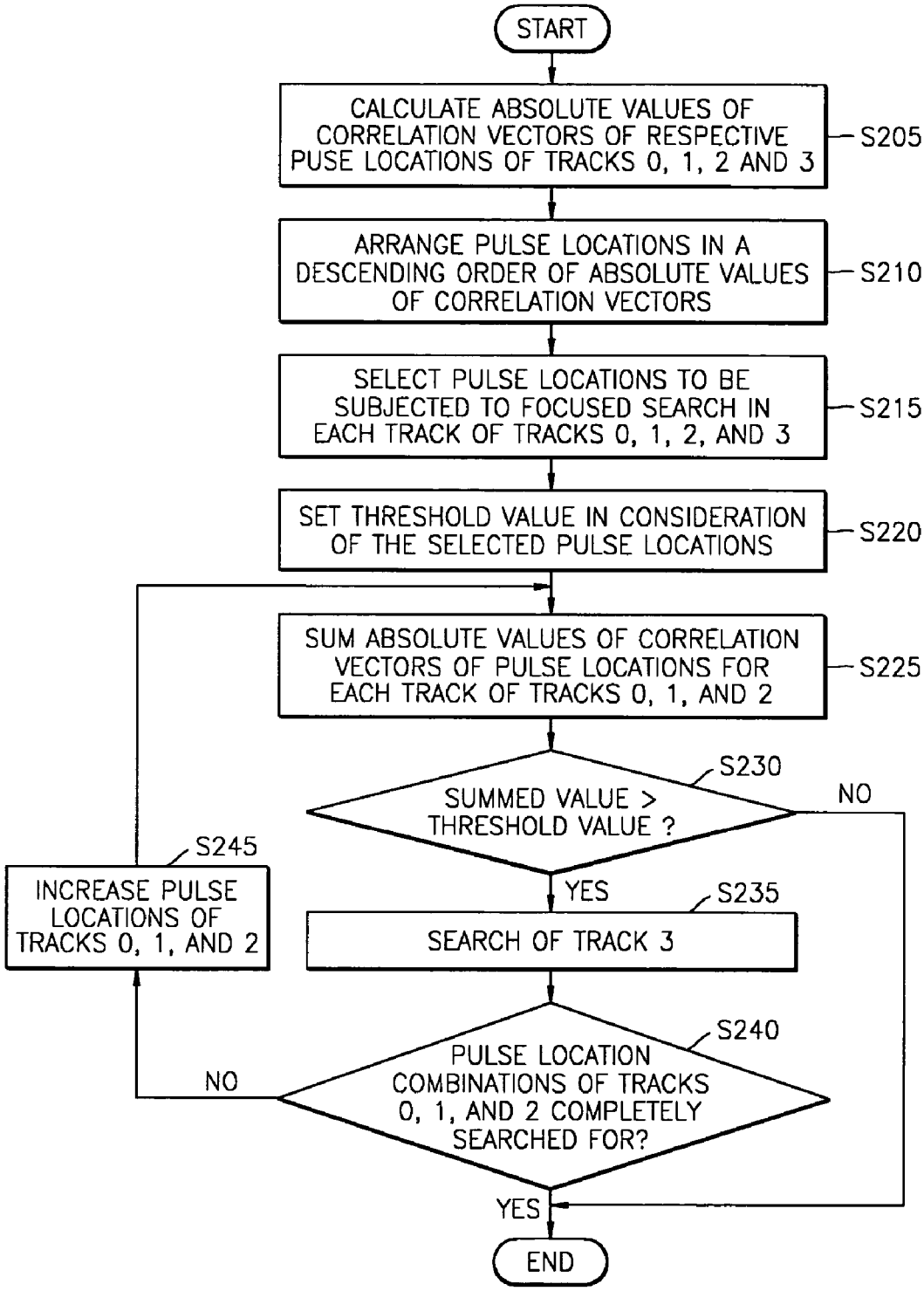
FIG. 2 is a flowchart illustrating a fixed codebook search method according to an embodiment of the present invention.

FIG. 2 is a flowchart illustrating a fixed codebook search method according to an embodiment of the present invention.

As shown in FIG. 2, the fixed codebook search method according to the present invention includes, obaining absolute values of correlation vectors for respective pulse locations of tracks 0, 1, 2, and 3 (step S205), arranging pulse locations in a descending order according to the absolute values of the correlation vectors in each track of tracks 0, 1, 2, and 3 (step S210), selecting candidate pulse locations to be subjected to focused search in each track of tracks 0, 1, 2, and 3 (step S215), setting a threshold value in consideration of the selected candidate pulse locations (step S220), summing absolute values of correlation vectors for respective pulse locations of tracks 0, 1, and 2 (step S225), determining whether the summed value is greater than the threshold value (step S230), searching for pulse locations of track 3 if the summed value is greater than the threshold value (step S235), and determining whether search is completely conducted for all pulse location combinations of tracks 0, 1, and 2 after search of track 3 is conducted (step S240).

In step S205, an absolute value |d(n)| of a correlation vector is obtained for each of pulse locations of each track of tracks 0, 1, 2, and 3. The correlation vector d(n) is calculated using the above Equation 2.

Table 2 lists absolute values of correlation vectors of respective pulse locations of tracks 0, 1, 2, and 3 in a specific subframe.

TABLE 2

| Track | Absolute value of correlation vector for each pulse location | | | | | | | |
|---|---|---|---|---|---|---|---|---|
| 0 | 56.11 | 110.50 | 33.91 | 36.76 | 83.44 | 150.36 | 11.32 | 116.58 |
| 1 | 57.89 | 35.60 | 27.68 | 59.62 | 99.47 | 182.05 | 9.63 | 6.84 |
| 2 | 63.87 | 10.30 | 56.40 | 51.64 | 87.08 | 110.81 | 12.83 | 99.37 |
| 3 | 173.46 | 45.46 | 7.33 | 67.34 | 50.33 | 52.22 | 28.83 | 122.37 |
| | 152.18 | 95.78 | 56.28 | 41.78 | 46.48 | 64.41 | 111.24 | 102.89 |

In step S210, the absolute values of the correlation vectors of the respective pulse locations are compared with each other for each track and the absolute values are arranged in a descending order, as shown in Table 2. The results are listed in Table 3.

Table 3 lists the pulse locations arranged in a descending order according to the absolute values of the correlation vectors in each track of tracks 0, 1, 2, and 3 in a specific subframe.

TABLE 3

| Track | Pulse location arranged in a descending order | | | | | | | |
|---|---|---|---|---|---|---|---|---|
| 0 | 25 | 35 | 5 | 20 | 0 | 15 | 10 | 30 |
| 1 | 26 | 21 | 16 | 1 | 6 | 11 | 31 | 36 |
| 2 | 27 | 37 | 22 | 2 | 12 | 17 | 32 | 7 |
| 3 | 3 | 38 | 38 | 28 | 23 | 8 | 33 | 13 |
| | 4 | 34 | 39 | 9 | 29 | 14 | 24 | 19 |

In step 215, only the upper M candidate pulse locations for each track are selected among the pulse locations arranged for each track, as shown in Table 3. Since the lower several pulse locations for each track have little probability of being selected as an optimal pulse location, the exclusion of these lower pulse locations does not have a great effect on performance. These selected results are listed in Table 4.

Table 4 lists the upper 6 pulse locations for each track selected among pulse locations arranged in a descending order in each track of tracks 0, 1, 2, and 3 of a specific subframe. That is, Table 4 lists the selected results when M=6.

TABLE 4

| Track | Candidate pulse locations to be used for search | | | | | |
|---|---|---|---|---|---|---|
| 0 | 25 | 35 | 5 | 20 | 0 | 15 |
| 1 | 26 | 21 | 16 | 1 | 6 | 11 |
| 2 | 27 | 37 | 22 | 2 | 12 | 17 |
| 3 | 3 | 38 | 18 | 28 | 23 | 8 |
| | 4 | 34 | 39 | 9 | 29 | 14 |

In step S220, the threshold value is calculated by a function of a maximal correlation value and an average correlation value obtained using only the upper M pulse locations selected for each track in the tracks 0, 1, and 2. A maximal correlation value of tracks 0, 1, and 2 is calculated according to Equation 7.

$$C_{max}^{M}=\max|d(T_0)|+\max|d(T_1)|+\max|d(T_2)| \tag{7}$$

Here, M is the number of candidate pulse locations selected for each track and $T_0$, $T_1$, and $T_2$ are track 0, 1, and 2, respectively.

Also, if a correlation vector whose absolute value is arranged in a descending order in each track of tracks 0, 1, and 2, is represented as $d_{re}(n)$, an average correlation value is calculated using the upper M pulse locations selected for each track of tracks 0, 1, and 2 according to Equation 8.

$$C_{av}^{M}=\frac{1}{M}\left\{\sum_{n=0}^{M-1}d_{re}(5n)+\sum_{n=0}^{M-1}d_{re}(5n+1)+\sum_{n=0}^{M-1}d_{re}(5n+2)\right\} \tag{8}$$

Accordingly, the threshold value is decided by Equation 9 using the maximal correlation value and the average correlation value.

$$C_{thr}^{M}=C_{av}^{M}+K(C_{max}^{M}-C_{av}^{M}) \tag{9}$$

Here, K is a constant for adjusting the number of pulse location combinations of tracks 0, 1, and 2 to be subjected to search.

For example, in a case where the absolute values of the correlation vectors are the same as in Table 2, the candidate pulse locations are obtained when M=1 as in Table 3, and K=0.4, a maximal correlation value, an average correlation value, and a threshold value are calculated using Equations 7 through 9, as follows.

The maximal correlation value is 443.22 as the sum of the greatest value 150.36 from track 0, the greatest value 182.05 from track 1, and the greatest value 110.81 from track 2.

The average correlation value is 247.53 calculated from {(150.36+116.58+110.50+83.44+56.11+36.76)+(182.05+99.47+59.62+57.89+35.60+27.68)+(110.81+99.37+87.08+63.87+56.40+51.64)}/6.

Also, the threshold value is 325.81 calculated from 247.53+0.4(443.22−247.53) using Equation 9.

In step S225, the absolute values of the correlation vectors of the respective pulse locations of the respective pulse location combinations of tracks 0, 1, and 2 are summed. Referring to Table 3, step S225 is to obtain a sum of the absolute values of the correlation vectors of the respective pulse locations for the respective pulse location combinations of tracks 0, 1, and 2. For example, since a first pulse location combination is (25, 26, 27), "|d(25)|+|d(26)|+|d(27)|" is calculated. In this case, the summed value is 150.36+182.05+110.81=443.22.

In step S230, the summed value for the pulse location combinations is compared with the threshold value obtained from the selected candidate pulse locations. If the summed value is greater than the threshold value, search of track 3 is conducted. If the summed value is equal to or smaller than the threshold value, fixed codebook search for the corresponding subframe is terminated. In the example of the first pulse location combination (25, 26, 27), the summed value is greater than the threshold value since the summed value is 150.36+182.05+110.81=443.22 and the threshold value is 325.81. Accordingly, search of track 3 is conducted.

In step S235, an optimal pulse location of track 3 is obtained for pulse location combinations corresponding when the summed value is greater than the threshold value in step S230. Particularly, when searching for the pulse locations of track 3, search is conducted only for the candidate pulse locations of track 3 selected in step S215 which selects the candidate pulse locations to be subjected to focused search.

In the above example of the first location combination (25, 26, 27), search of track 3 is conducted for combinations (25, 26, 27, 3), (25, 26, 27, 38), . . . , (25, 26, 27, 23), (25, 26, 27, 8), . . . , (25, 26, 27, 4), (25, 26, 27, 34), (25, 26, 27, 29), (25, 26, 27, 14). In another example, if a summed value of absolute vectors of correlation vectors of a pulse location combination (35, 21, 22) in Tables 3 and 4 is greater than the threshold value, search candidates for searching for an optimal pulse location in tracks 0, 1, 2, and 3 are (35, 21, 22, 3), (35, 21, 22, 38), . . . , (35, 21, 22, 23), (35, 21, 22, 8), (35, 21, 22, 4), (35, 21, 22, 34), . . . , (35, 21, 22, 29), (35, 21, 22, 14).

In step S240, it is determined whether search of track 3 was conducted for all candidate pulse location combinations of the cases where the summed value is greater than the threshold value. If all pulse location combinations of tracks 0, 1, and 2 are not completely searched for, the pulse locations of tracks 0, 1, and 2 increase (step S245). That is, to create all possible pulse locations combinations, the pulse locations of tracks 0, 1, and 2 increase one for each track. At this time, the pulse locations increase in an order of track 2, track 1, and track 0.

In step S230, if the summed value is equal to or smaller than the threshold value, fixed codebook search for the corresponding subframe is terminated. That is, if the summed value is equal to or smaller than the threshold value, search for track 3 is not conducted for and fixed codebook search of the corresponding subframe is terminated since the summed value in the remaining combinations is not greater than the threshold value.

Therefore, it is possible to significantly reduce a calculation amount required for fixed codebook search while maintaining tone quality in a similar level, by applying the focused search method only to the remaining pulse locations excluding the pulse locations having little probability of being selected as an optimal pulse location in each track of tracks 0, 1, 2, and 3.

Also, the fixed codebook search method used in the sound codec, according to the present invention, can be utilized for various types of fixed codebook searches having an algebraic codebook structure.

Figure 3:
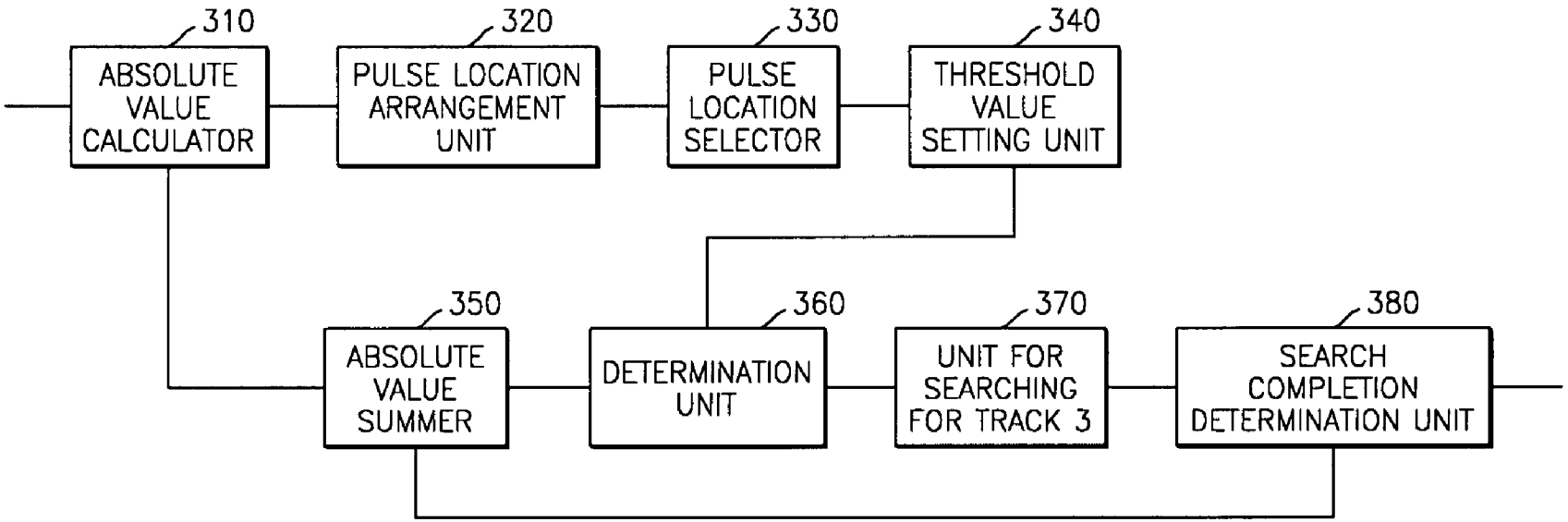
FIG. 3 is a block diagram of a fixed codebook search apparatus according to an embodiment of the present invention.

FIG. 3 is a block diagram of a fixed codebook search apparatus, according to the present invention.

The fixed codebook search apparatus according to the present invention comprises an absolute value calculator 310, a pulse location arrangement unit 320, a pulse location selector 330, a threshold value setting unit 340, an absolute value summer 350, a determination unit 360, a unit 370 for searching for track 3, and a search completion determination unit 380.

The absolute value calculator 310 calculates absolute values of correlation vectors of respective pulse locations of tracks 0, 1, 2, and 3.

The pulse location arrangement unit 320 arranges pulse locations in a descending order in each track of tracks 0, 1, 2, and 3 according to the absolute values of the correlation vectors calculated in the absolute value calculator 310.

The pulse location selector 330 selects candidate pulse locations to be subjected to focused search in each track of tracks 0, 1, 2, and 3.

The threshold value setting unit 340 sets a threshold value from the selected candidate pulse locations.

The absolute value summer 350 sums the absolute values of the correlation vectors of the respective pulse locations of tracks 0, 1, and 2.

The determination unit 360 determines whether the summed value is greater than the threshold value.

The unit 370 for searching for track 3 searches for the pulse locations of track 3 when the summed value is greater than the threshold value.

The search completion determination unit 380 determines whether all pulse location combinations of tracks 0, 1, and 2 are completely searched for after search of track 3 is conducted.

The present invention may be embodied as a program on a computer readable medium including, but not limited to storage media, such as magnetic storage media (e.g., ROM's, floppy disks, hard disks, etc.), optically readable media (e.g., CD-ROMs, DVDs, etc.) and carrier waves (e.g., transmissions over the Internet). To be executed in an independent or present invention may be embodied as a distributed manner.

As described above, according to the present invention, it is possible to significantly reduce a calculation amount required for fixed codebook search while maintaining tone quality in a similar level, by applying the focused search method to the remaining pulse locations excluding the pulse locations having little probability of being selected as an optimal pulse location in each track of tracks 0, 1, 2, and 3.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A focused search method of a fixed codebook, the method comprising:

calculating absolute values of correlation vectors of respective pulse locations of tracks 0, 1, 2, and 3 included in the fixed codebook and arranging the pulse locations in a descending order of the absolute values;

selecting a predetermined number of pulse locations for each track among candidate pulse locations arranged and conducting focused search of the selected result; and using the focused search to encode the pulse locations.

2. A focused search method of a fixed codebook, the method comprising:

calculating absolute values of correlation vectors for respective pulse locations of tracks 0, 1, 2, and 3 included in the fixed codebook;

arranging the pulse locations according to the absolute values of the correlation vectors in each track of the tracks 0, 1, 2, and 3;

selecting candidate pulse locations to be subjected to focused search in each track of the tracks 0, 1, 2, and 3;

setting a threshold value in consideration of the selected candidate pulse locations;

summing the absolute values of the correlation vectors for each track;

determining whether the summed value is greater than the threshold value;

searching for pulse locations of track 3 if the summed value is greater than the threshold value and terminating search if the summed value is equal to or smaller than the threshold value;

determining whether all pulse location combinations of the tracks 0, 1, and 2 are completely searched for after search of the track 3 is conducted;

increasing the respective pulse locations of the tracks 0, 1, and 2 by one and feeding back to step of summing the absolute values of the correlation vectors if the all pulse location combinations are not completely searched for; and using the completed searches to encode the pulse locations.

3. The method of claim 2, wherein in arrangement of the pulse locations, the pulse locations are arranged in a descending order according to the absolute values of the correlation vectors.

4. The method of claim 2, wherein in selection of the candidate pulse locations, a predetermined number of candidate pulse locations for each track are selected in a descending order of the absolute values of the correlation vectors.

5. The method of claim 2, wherein the threshold value is obtained by a function of a maximal correlation value and an average correlation value which are calculated using a predetermined number of pulse locations selected for each track in the tracks 0, 1, and 2.

6. The method of claim 2, wherein the threshold value is obtained by the following Equation:

$$C_{thr}^{M}=C_{av}^{M}+K(C_{max}^{M}-C_{av}^{M})$$

wherein $c_{max}^{M}$ is a maximal correlation value, $c_{av}^{M}$ is an average correlation value, M represents the number of the candidate pulse locations selected for each track, and $T_0$, $T_1$, and $T_2$ are the tracks 0, 1, and 2, respectively.

7. The method of claim 6, wherein the maximal correlation value is obtained by the following Equation:

$$C_{max}^{M}=\max|d(T_0|+\max|d(T_1|+\max|d(T_2|$$

wherein M represents the number of the candidate pulse locations selected for each track, $T_0$, $T_1$, and $T_2$ are the tracks 0, 1, and 2, respectively, and d represents the correlation vector.

8. The method of claim 6, wherein the average correlation value is obtained by the following Equation:

$$C_{av}^{M}=\frac{1}{M}\left\{\sum_{n=0}^{M-1}d_{re}(5n)+\sum_{n=0}^{M-1}d_{re}(5n+1)+\sum_{n=0}^{M-1}d_{re}(5n+2)\right\}$$

wherein M represents the number of candidate pulse locations selected for each track and d.sub.re(n) represents newly-designated correlation vectors for the absolute values of the correlation vectors arranged in a descending order.

9. A computer readable medium having embodied thereon a computer program for a focused search method of claim 2.

10. A focused search apparatus of a fixed codebook comprising:

an absolute value calculator which calculates absolute values of correlation vectors of respective pulse locations of tracks 0, 1, 2, and 3 included in the fixed codebook;

a pulse location arrangement unit which arranges pulse locations in each track of the tracks 0, 1, 2, and 3 according to the absolute values of the correlation vectors calculated in the absolute value calculator;

a pulse location selector which selects candidate pulse locations to be subjected to focused search in each track of the tracks 0, 1, 2, and 3;

a threshold value setting unit which sets a threshold value in consideration of the selected candidate pulse locations;

an absolute value summer which sums the absolute values of the correlation vectors of the respective pulse locations of the tracks 0, 1, and 2;

a determination unit whether determines whether the summed value is greater than the threshold value;

a unit for searching for pulse locations of track 3 if the summed value is greater than the threshold value; and a search completion determination unit which determines whether all pulse location combinations of the tracks 0, 1, and 2 are completely searched for after search of the track 3 is conducted, the completed searches to be used for encoding the pulse locations.

11. The apparatus of claim 10, wherein the pulse location arrangement unit arranges the absolute values of the correlation vectors in a descending order in each track of the tracks 0, 1, 2, and 3.

12. The apparatus of claim 10, wherein the pulse location selector selects a predetermined number of candidate pulse locations for each track in a descending order of the absolute values of the correlation vectors.

13. The apparatus of claim 10, wherein the threshold value setting unit sets a threshold value by a function of a maximal correlation value and an average correlation value using a predetermined number of pulse locations selected for each track.

* * * * *